US007511668B2

(12) United States Patent
Hirabayashi

(10) Patent No.: US 7,511,668 B2
(45) **Date of Patent: *Mar. 31, 2009**

(54) ANTENNA DEVICE, RADIO DEVICE, AND ELECTRONIC INSTRUMENT

(75) Inventor: Takayuki Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 159 days.

This patent is subject to a terminal disclaimer.

(21) Appl. No.: 10/545,313

(22) PCT Filed: Dec. 15, 2004

(86) PCT No.: PCT/JP2004/019145

§ 371 (c)(1),
(2), (4) Date: Apr. 13, 2006

(87) PCT Pub. No.: WO2005/062417

PCT Pub. Date: Jul. 7, 2005

(65) Prior Publication Data

US 2006/0208949 A1 Sep. 21, 2006

(30) Foreign Application Priority Data

Dec. 19, 2003 (JP) ..... 2003-423852

(51) Int. Cl.
*H01Q 1/38* (2006.01)

(52) U.S. Cl. ..... 343/700 MS; 343/876

(58) Field of Classification Search ..... 343/700 MS, 343/876

See application file for complete search history.

(56) References Cited

U.S. PATENT DOCUMENTS 6,518,923 B2 * 2/2003 Barquist et al. ..... 343/700 MS
6,703,981 B2 * 3/2004 Meitzler et al. ..... 343/755

FOREIGN PATENT DOCUMENTS

| | | |
|---|---|---|
| DE | 101 18 487 A1 | 10/2002 |
| EP | 1 233 426 A2 | 8/2002 |
| GB | 2 388 744 | 11/2003 |

(Continued)

OTHER PUBLICATIONS

U.S. Appl. No. 10/545,313, filed Aug. 12, 2005, Hirabayashi.

(Continued)

*Primary Examiner*—Trinh V Dinh
*Assistant Examiner*—Dieu Hien T Duong
(74) *Attorney, Agent, or Firm*—Oblon, Spivak, McClelland, Maier & Neustadt, P.C.

(57) ABSTRACT

An antenna apparatus 1 has an antenna substrate 21 composed of a separator 23 and electrolyte layers 24*a* and 24*b* disposed on both surfaces of the separator 23; an antenna pattern 22*a* disposed on the solid electrolyte layer 24*a*; and an antenna pattern 22*b* disposed on the solid electrolyte layer 24*b*. The antenna patterns 22*a* and 22*b* are made of an electroconductive plastic. When a DC voltage is applied between the antenna patterns 22*a* and 22*b*, ions can be doped to one of the antenna patterns 22*a* and 22*b*, whereas ions can be undoped form the other of the antenna patterns 22*a* and 22*b*. In other words, one of the antenna patterns 22*a* and 22*b* can become a conductor, whereas the other thereof can become an insulator.

27 Claims, 12 Drawing Sheets

FOREIGN PATENT DOCUMENTS

| | | |
|---|---|---|
| JP | 6-310167 | 11/1994 |
| JP | 2002-16433 | 1/2002 |
| JP | 2002-246839 | 8/2002 |
| JP | 2003-8308 | 1/2003 |
| JP | 2003-124729 | 4/2003 |
| WO | WO 91/03921 | 3/1991 |

OTHER PUBLICATIONS

U.S. Appl. No. 10/544,067, filed Aug. 2, 2005, Hirabayashi.

* cited by examiner

ANTENNA DEVICE, RADIO DEVICE, AND ELECTRONIC INSTRUMENT

TECHNICAL FIELD

The present invention relates to an antenna apparatus having a plurality of antenna elements; a wireless apparatus therewith; and an electronic apparatus therewith.

BACKGROUND ART

In recent years, a wireless communication function has been mounted on not only information processing devices, such as personal computers, and communication terminal devices, such as cellular phones and PDAs (Personal Digital Assistances), but also various types of consumer electronic devices, such as audio devices, video devices, camera devices, printers, and entertainment robots. In addition, the wireless communication function has been mounted on wireless LAN (Local Area Network) access points and small accessory cards. The accessory cards are wireless card modules having both a storage function and a wireless communication function. Known as wireless card modules are for example PCMCIA (Personal Computer Memory Card International Association) type cards, compact flash cards, mini PCI (Peripheral Component Interconnection) cards.

As the wireless communication function has been mounted on various devices, antennas that receive and transmit radio waves have needed various shapes and characteristics. For example, antennas that can deal with a wide frequency band and multiple frequencies have been needed.

For example, for 5 GHz band used in the wireless LAN, antennas have been needed for 4.9 GHz band and 5.8 GHz band that are wider than the existing 5.15 to 5.35 GHz bands. In addition, to satisfy the IEEE (Institute of Electrical and Electronics Engineers) 802.11a/b/g standards, antennas are needed to cover both the frequency bands 2.4-2.5 GHz and 5.15-5.35 GHz. In an ultra wide band (UWB), which is gaining attention, antennas need to cover wide bands of 3.1 GHz-10.6 GHz. There is a possibility that the UHF bands (400-800 MHz) of ground wave digital broadcasts and high speed wide band milli-wave communication systems (25 GHz band, 60 GHz band, and so forth) will be combined in future.

So far, to cover a plurality of frequencies, the following methods have been proposed: (1) an antenna is designed to have a main resonance and a sub resonance, and (2) an antenna is designed to broaden a frequency band with one resonance. The method (1) of these methods has been widely used in many commercial antennas.

However, these methods have the following problems. The method (1) sacrifices characteristics such as "deterioration of return loss characteristics" "narrow frequency band" in one of a plurality of bands. In contrast, the method (2) sacrifices a gain of a radio wave in a widened band because the band and gain have a reversely proportional relationship.

In an ideal method of widening a frequency band, which has been proposed, a plurality of antenna elements corresponding to necessary frequency bands are mounted on a device (as disclosed in for example Japanese Patent Laid-Open Publication No. 2002-92576).

FIG. 17 shows an example of an antenna substrate having a plurality of antenna patterns. FIG. 17A is a plan view showing one principal surface $S_3$ of an antenna substrate 101. FIG. 17B is a plan view showing another principal surface $S_4$ of the antenna substrate 101. As shown in FIG. 17A and FIG. 17B, the principal surface $S_3$ of the antenna substrate 101 has a first antenna pattern 102*a*. The other principal surface $S_4$ of the antenna substrate 101 has a second antenna pattern 102*b*. The first antenna pattern 102*a* is an antenna pattern corresponding to frequency bands 4.9-5.35 GHz, an antenna pattern corresponding to frequency bands 2.4-2.5 GHz, or an antenna pattern for a DT (Digital Television) corresponding to frequency bands 400-800 MHz. The second antenna pattern 102*b* is an antenna pattern corresponding to frequency bands 5.35 GHz-5.8 GHz or an antenna pattern corresponding to milli-wave bands.

However, if a plurality of antenna patterns are closely disposed and mounted on a device, they interfere with each other and their characteristics deteriorate. To solve this problem, if a plurality of antenna patterns are disposed with sufficient clearance areas, the size of the device becomes large.

If the antenna substrate 101 shown in FIG. 17 is thinned out (for example, 1 mm or less), the first antenna pattern 102*a* and the second antenna pattern 102*b* disposed on both the principal surfaces largely interfere with each other. As a result, characteristics of the antenna deteriorate. Thus, as shown in FIG. 18, the first antenna pattern 102*a* and the second antenna pattern 102*b* have to be disposed on the antenna substrate 101 with a sufficient clearance area.

As described above, when a plurality of antenna elements are mounted on a device, the size of the device becomes large. Thus, this method does not satisfy the present needs of which the wireless function is mounted on various consumer devices. Thus, under the existing circumstances, such a method has been hardly used in real devices.

Therefore, an object of the present invention is to provide an antenna apparatus that allows a plurality of antenna patterns to be closely disposed and deterioration of characteristics due to interference of antenna patterns to be suppressed; a wireless apparatus therewith; and an electronic apparatus therewith.

DISCLOSURE OF THE INVENTION

To solve the foregoing problem, the first invention is an antenna apparatus, comprising:

a substrate; and a plurality of antenna patterns disposed on the substrate, wherein the antenna patterns being made of an electroconductive plastic, and wherein the substrate is made of a solid electrolyte.

In the first invention, it is preferred that the substrate also have a separator and that solid electrolyte layers made of the solid electrolyte be disposed on both surfaces of the separator. The plurality of antenna patterns typically correspond to different frequency bands. The plurality of antenna patterns are typically linear patterns.

In the first invention, the substrate is typically a planar substrate. The plurality of antenna patterns are typically disposed on either or both principal surfaces of the substrate. When the plurality of antenna patterns are disposed on one principal surface of the substrate, it is preferred that a base plate made of a metal be disposed on the other principal surface of the substrate. When the base plate made of a metal is disposed on the other principal surface of the substrate, the plurality of antenna patterns are typically planner patterns.

According to the first invention, by applying the DC voltage between the plurality of antenna patterns disposed on the solid electrolyte, ions can be doped from the substrate to an antenna pattern having one potential, whereas ions can be undoped from another antenna pattern having the other potential to the substrate. In other words, with a potential difference between the antenna patterns, the antenna pattern having one potential can become a conductor, whereas the antenna pattern having the other potential can become an insulator.

The second invention is a wireless apparatus that is connected to a device and that allows it to additionally have a wireless function, the wireless apparatus comprising:

a substrate;

a plurality of antenna patterns disposed on the substrate; and a switch that selects the plurality of antenna patterns so that one of the plurality of antenna patterns has one potential and the other of the plurality of antenna patterns has another potential when a DC voltage is applied between the plurality of antenna patterns;

wherein the antenna patterns are made of an electroconductive plastic, and wherein the substrate is made of a solid electrolyte.

In the second invention, it is preferred that the substrate also have a separator and that solid electrolyte layers made of the solid electrolyte be disposed on both surfaces of the separator. The plurality of antenna patterns typically correspond to different frequency bands. The plurality of antenna patterns are typically linear patterns.

In the second invention, the substrate is typically a planar substrate. The plurality of antenna patterns are typically disposed on either or both principal surfaces of the substrate. When the plurality of antenna patterns are disposed on one principal surface of the substrate, it is preferred that a base plate made of a metal be disposed on the other principal surface of the substrate. When the base plate made of a metal is disposed on the other principal surface of the substrate, the plurality of antenna patterns are typically planner patterns.

According to the second invention, by applying the DC voltage between the plurality of antenna patterns disposed on the solid electrolyte, ions can be doped from the substrate to an antenna pattern having one potential, whereas ions can be undoped from another antenna pattern having the other potential to the substrate. In other words, with a potential difference between the antenna patterns, the antenna pattern having one potential can become a conductor, whereas the antenna pattern having the other potential can become an insulator.

The third invention is an electronic apparatus having a wireless communication function that transmits and receives information, the electronic apparatus comprising:

a substrate;

a plurality of antenna patterns disposed on the substrate;

a voltage source that applies a DC voltage between the plurality of antenna patterns; and a switch that selects the plurality of antenna patterns so that one of the plurality of antenna patterns has one potential and the other of the plurality of antenna patterns has another potential when the DC voltage is applied between the plurality of antenna patterns, wherein the antenna patterns are made of an electroconductive plastic, and wherein the substrate is made of a solid electrolyte.

In the third embodiment, it is preferred that the substrate also have a separator and that solid electrolyte layers made of the solid electrolyte be disposed on both surfaces of the separator. The plurality of antenna patterns typically correspond to different frequency bands. The plurality of antenna patterns are typically linear patterns.

In the third embodiment, the substrate is typically a planer substrate. The plurality of antenna patterns are typically disposed on either or both principal surfaces of the substrate. When the plurality of antenna patterns are disposed on one principal surface of the substrate, it is preferred that a base plate made of a metal be disposed on the other principal surface of the substrate. When the base plate made of a metal is disposed on the other principal surface of the substrate, the plurality of antenna patterns are typically planner patterns.

According to the third invention, by applying the DC voltage between the plurality of antenna patterns disposed on the solid electrolyte, ions can be doped from the substrate to an antenna pattern having one potential, whereas ions can be undoped from another antenna pattern having the other potential to the substrate. In other words, with a potential difference between the antenna patterns, the antenna pattern having one potential can become a conductor, whereas the antenna pattern having the other potential can become an insulator.

As described above, according to the present invention, by applying the DC voltage between the plurality of antenna patterns disposed on the solid electrolyte, ions can be doped from the substrate to an antenna pattern having one potential, whereas ions can be undoped from another antenna pattern having the other potential to the substrate. In other words, with a potential difference between the antenna patterns, the antenna pattern having one potential can become a conductor, whereas the antenna pattern having the other potential can become an insulator. Thus, even if the plurality of antenna elements are closely disposed, deterioration of characteristics due to interference of the antenna elements can be suppressed.

BEST MODES FOR CARRYING OUT THE INVENTION

Figure 1:
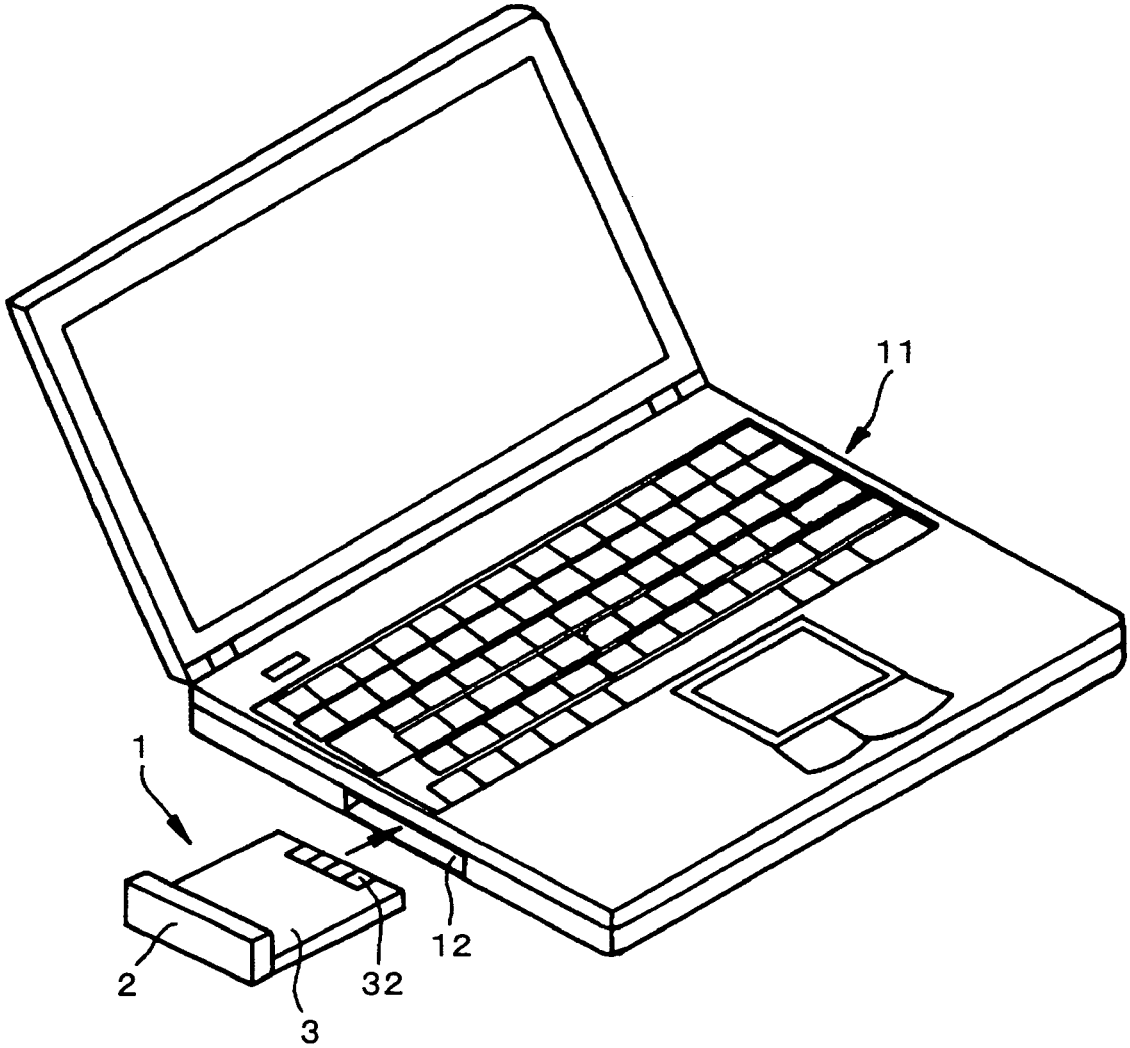
FIG. 1 is a schematic diagram showing an example of an electronic apparatus to which a wireless apparatus according to a first embodiment of the present invention is mounted.

Next, with reference to the accompanying drawings, embodiments of the present invention will be described. In all the drawings of the embodiments of the present invention, similar or corresponding elements are denoted by similar or corresponding reference numerals.

FIG. 1 shows an example of an electronic apparatus to which a wireless apparatus 1 according to a first embodiment of the present invention is attached. The wireless apparatus 1 is composed of a wireless apparatus main body 3 and an antenna apparatus 2 disposed at one end of the wireless apparatus main body 3. The wireless apparatus 1 is a wireless card module that has for example a storage function and a wireless communication function. The wireless card module is for example a PCMCIA type card, a compact flash card, a mini PCI card, or the like.

The wireless apparatus 1 has a structure that can be freely attached to and detached from a slot 12 disposed in an electronic apparatus 11 such as a personal computer. Specifically, as shown in FIG. 1, the wireless apparatus 1 is attached to the slot 12 so that one end of the wireless apparatus main body 3, which is the antenna apparatus 2, protrudes from the electronic apparatus 11. With the wireless apparatus 1, a predetermined extension function and a wireless communication function are provided to the electronic apparatus 11. In addition, the wireless apparatus 1 has a storage function that exchanges data with the electronic apparatus 11.

Figure 2:
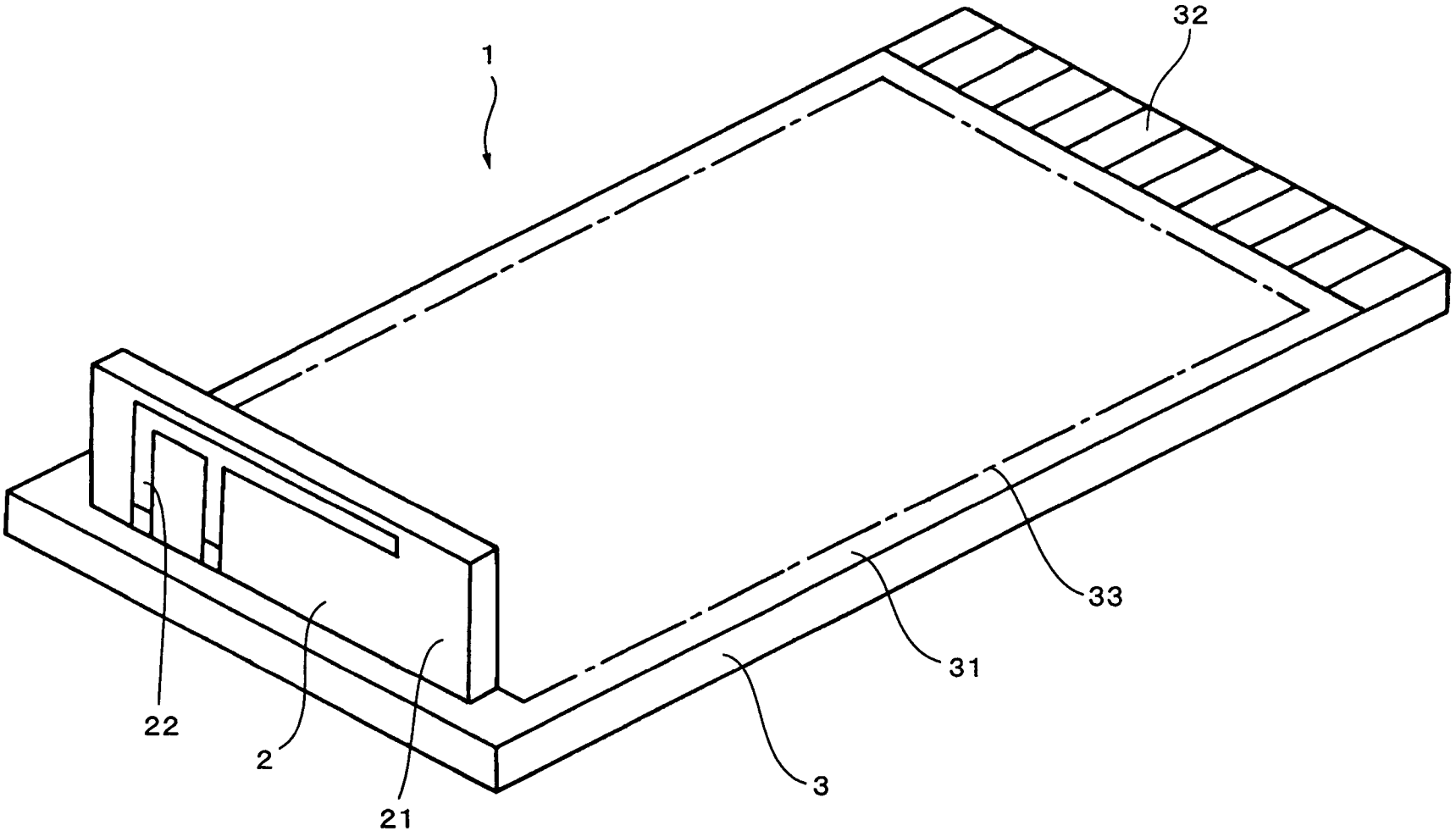
FIG. 2 is a perspective view showing an example of a wireless apparatus 1 disposed in a housing.

FIG. 2 is a perspective view showing an example of the wireless apparatus 1 disposed in a housing. As shown in FIG. 2, the wireless apparatus main body 3 is composed of a main body substrate 31 having a rectangle shape viewed from the above of its principal surface; a connection terminal 32 disposed on one shorter side of the rectangle; and a circuit portion 33 disposed at a center portion of the wireless apparatus 1. The connection terminal 32 is a connector portion based on for example the PCMCIA standard. By inserting the connection terminal 32 of the wireless apparatus 1 into the slot 12 of the electronic apparatus 11, the connection terminal 32 and a corresponding connection terminal disposed inside the slot 12 are connected. As a result, the electronic apparatus 11 is provided with the wireless function. The circuit portion 33 has for example an antenna control circuit, a signal process circuit, and a storage function memory device.

The antenna apparatus 2 mainly has a planar antenna substrate 21 and a plurality of antenna patterns 22 disposed on both principal surfaces of the antenna substrate 21. The antenna apparatus 2 is disposed on the other shorter side opposite to the connection terminal 32. The antenna apparatus 2 has a rectangle shape viewed from its principal surface. The length of each of the longer sides of the rectangle is slightly smaller than the width of the main body substrate 31. The length of each of the shorter sides of the antenna apparatus 2 is slightly larger than the height of the opening of the slot 12 of the electronic apparatus 11. A longer side portion of the antenna apparatus 2 has a connection portion that connects the antenna apparatus 2 and the main body substrate 31.

Figure 3A:
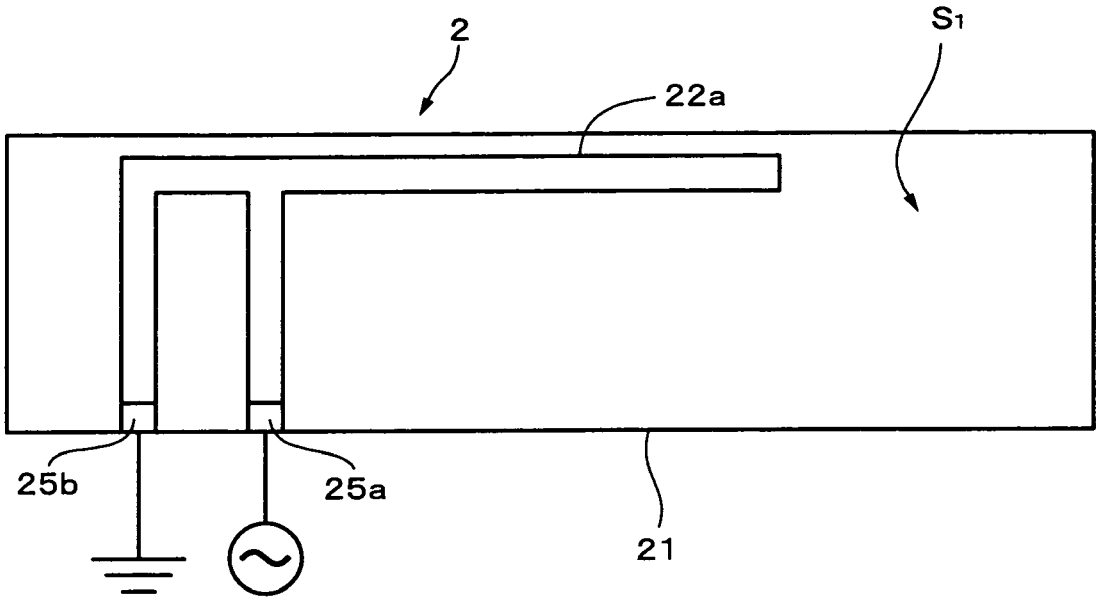
FIG. 3 is a plan view showing an antenna apparatus according to the first embodiment of the present invention.
Figure 3B:
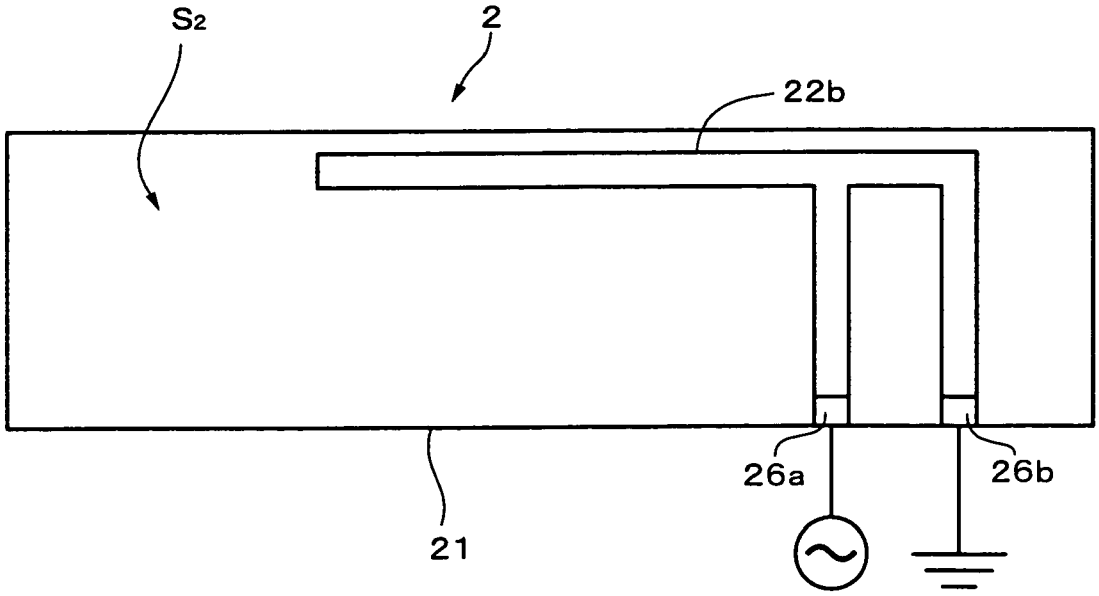

FIG. 3A is a plan view showing one principal surface of the antenna apparatus 2 according to the first embodiment of the present invention. FIG. 3B is a plan view showing the other principal surface of the antenna apparatus 2 according to the first embodiment of the present invention. As shown in FIG. 3A, an antenna pattern 22*a* is disposed on one principal surface $S_1$ of the antenna substrate 21. An antenna pattern 22*b* is disposed on the other principal surface $S_2$ of the antenna substrate 21. Electrodes 25*a* and 25*b* are disposed on the antenna pattern 22*a* on the connection portion side of the antenna substrate 21. Electrodes 26*a* and 26*b* are disposed on the antenna pattern 22*b* on the connection portion side of the antenna substrate 21. The electrodes 25*a*, 25*b*, 26*a*, and 26*b* are made of for example a metal such as copper. The electrodes 25*a* and 25*b* are connected to the signal process circuit of the circuit portion 33. The electrodes 25*b* and 26*b* are connected to a ground pattern disposed on the circuit portion 33.

The antenna patterns 22*a* and 22*b* correspond to different frequency bands. The frequency bands are for example 5 GHz bands, 2.4 GHz bands, milli-wave bands, micro-wave bands, and UHF bands.

Figure 4A:
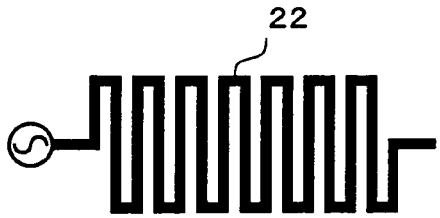
FIG. 4 is a schematic diagram showing examples of antenna patterns.
Figure 4B:
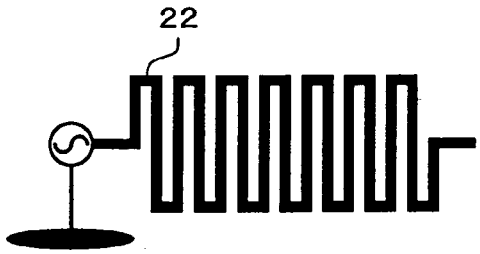
Figure 4C:
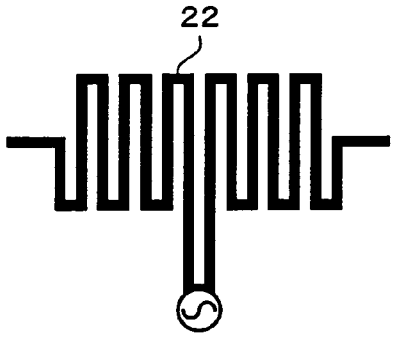

FIG. 4 shows examples of the antenna patterns 22. The antenna patterns 22 are for example linear patterns or planar patterns. The linear patterns are for example Zepp type (FIG. 4A), monopole type (FIG. 4B), dipole type (FIG. 4C), inverse F type, and meander type. The planner patterns are for example micro-strip type antenna, and PIFA (Planer Inverted F Antenna). When the antenna patterns 22*a* and 22*b* are mono-pole type antenna elements, the antenna apparatus 2 is provide with a base plate. When the antenna patterns 22*a* and 22*b* are dipole type antenna elements, they are balance-fed.

Figure 5:
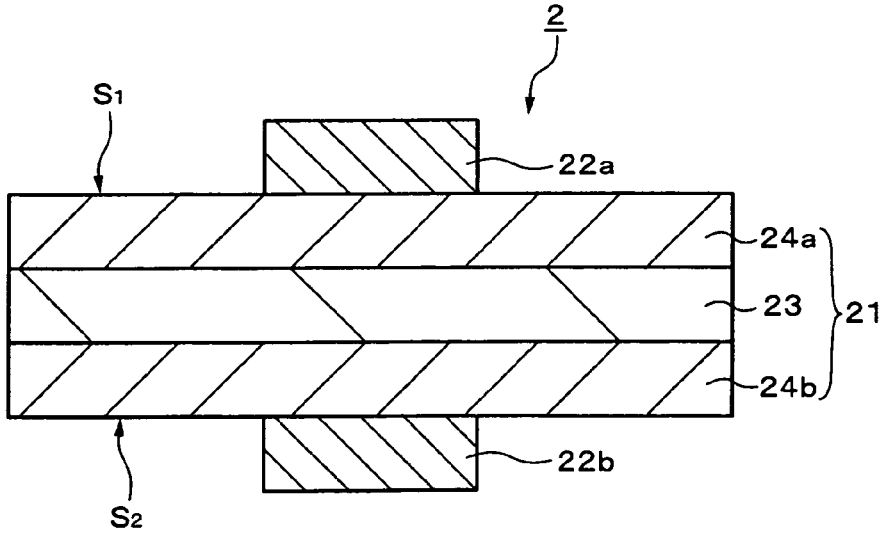
FIG. 5 is a sectional view showing an example of the structure of the antenna apparatus according to the first embodiment of the present invention.

FIG. 5 is a sectional view showing an example of the structure of the antenna substrate 21. As shown in FIG. 5, the antenna substrate 21 is composed of an electrolyte layer 24*b*, a separator 23, and an electrolyte layer 24*a* that are layered in the order. The antenna patterns 22*a* and 22*b* are disposed on the electrolyte layers 24*a* and 24*b*, respectively.

The antenna patterns 22*a* and 22*b* are made of an electroconductive plastic. When the electroconductive plastic is doped with ions, it becomes an electroconductive resin like a metal. When the electroconductive plastic is undoped, it becomes an insulative resin. As the electroconductive plastic that can be used and known is for example polyacetylene, polythiophene, polypyrrole, polyaniline, or polyazulen.

The antenna patterns 22*a* and 22*b* can be disposed in one of the following methods. As one method, molten electroconductive plastic is coated on the electrolyte layers 24*a* and 24*b* for desired patterns and then hardened. As another method, after molten electroconductive plastic is shaped in desired antenna patterns and hardened, they are disposed on the electrolyte layers 24*a* and 24*b*. As another method, film-shaped electroconductive plastic is formed by electrolytic polymerization. The electroconductive plastic is cut or punched out in desired shapes and disposed on the electrolyte layers 24*a* and 24*b*.

It is preferred that the antenna patterns 22*a* and 22*b* be stably secured on the solid electrolyte layers 24*a* and 24*b*, respectively. As a stably securing method, the antenna patterns 22*a* and 22*b* are adhered to the solid electrolyte layers 24*a* and 24*b*, respectively, with an adhesive agent. As another method, the antenna patterns 22*a* and 22*b* are coated with a sheet. As another method, concave portions corresponding to the shapes of the antenna patterns 22*a* and 22*b* are formed in the solid electrolyte layers 24*a* and 24*b*, respectively. The antenna patterns 22*a* and 22*b* are fit to the concave portions. As another method, several positions of the antenna patterns 22*a* and 22*b* are secured to the solid electrolyte layers 24*a* and 24*b* with securing members or the like. As another method, these methods may be combined. When the antenna patterns 22*a* and 22*b* are adhered to the solid electrolyte layers 24*a* and 24*b* with adhesive agent, the thickness of the adhesive agent needs to be decreased so that ions can easily migrate. In addition, it is preferred that the antenna patterns 22*a* and 22*b* and the solid electrolyte layers 24*a* and 24*b* be adhered at several positions with adhesive agent so that ions are not prevented from migrating. When the antenna patterns 22*a* and 22*b* are secured to the solid electrolyte layers 24*a* and 24*b* with securing members or the like, it is preferred that easily peelable portions of the antenna patterns 22*a* and 22*b* be secured. It is preferred that the material of the sheet that covers the antenna patterns 22*a* and 22*b* be a material that is free of deterioration of radio wave characteristics thereof and that has flexibility. The material of the sheet is for example polycarbonate (PC), acrylonitorile-butadiene-styrene (ABS), or polyimide.

The solid electrolyte layers 24*a* and 24*b* have a rectangle shape viewed from the above of their principal surfaces. The solid electrolyte layers 24*a* and 24*b* contain ions (dopants) that are doped to electroconductive plastic. These ions are cations or anions. The solid electrolyte that composes the solid electrolyte layers 24*a* and 24*b* are for example solid electrolyte used for battery cells such as lithium ion battery cells (lithium polymer battery cells), and fuel battery cells.

The solid electrolytic that composes the solid electrolyte layers 24*a* and 24*b* may be inorganic electrolyte, polymer electrolyte, or gel-type electrolyte of which electrolyte is mixed with a highly polymerized compound. The gel-type electrolyte is composed of for example plasticizing agent containing lithium salt and 2% to 30% by percent of a matrix polymer. At this point, an ester group, an ether group, or a carbonate group may be used as a single component or one component of plasticizing agent.

As a polymeric material of the solid electrolyte layers 24*a* and 24*b*, for example silicon gel, acrylic gel, polysaccharide group polymer, acrylonitrile gel, polyphosphazen denatured polymer, polyethylene oxide, polypropylene oxide, composite polymer thereof, cross-linked polymer thereof, or denatured polymer thereof, fluorinated polymer, such as poly(vinylidene fluororide), poly(vinylidene fluororide-co-hexafluoropropylene), poly(vinylidene fluororide-co-tetrafluoropropylene), poly(vinylidene fluororide-co-trifluoropropylene), or a mixture thereof can be used.

The electrolyte salt is for example lithium salt or sodium salt. The lithium salt is for example a regular lithium salt used for an electrolytic solution of a regular battery cell. The lithium salt is for example as follows, but not limited thereto.

The lithium salt is for example lithium chloride, lithium bromide, lithium iodide, lithium chlorate, lithium perchlorate, lithium bromate, lithium iodate, lithium nitrate, tetrafluoro lithium borate, hexafluoro lithium phosphate, lithium acetate, bis(trifluoro methane sulfonyl) imidolithium, $LiAsF_6$, $LiCF_3SO_3$, $LiC(SO_2CF_3)_3$, $LiAlCl_4$, or $LiSiF_6$. A single compound or a mixture of two or more compounds of these lithium compounds may be used.

The separator 23 has a rectangle sheet shape when viewed from the above of its principal surface. The separator 23 is used to separate the solid electrolyte layers 24*a* and 24*b*. As the separator 23, a separator that is known for regular battery cells can be used. The separator 23 is for example a porous film made of a polyolefin type material such as polypropylene or polyethylene; a porous film made of an inorganic material such as a nonwoven substance of a ceramic material; or a laminate of two or more types of these materials. In consideration of the strength of the antenna substrate 21, it is preferred that the separator 23 be disposed. However, the separator 23 may be omitted.

Figure 6:
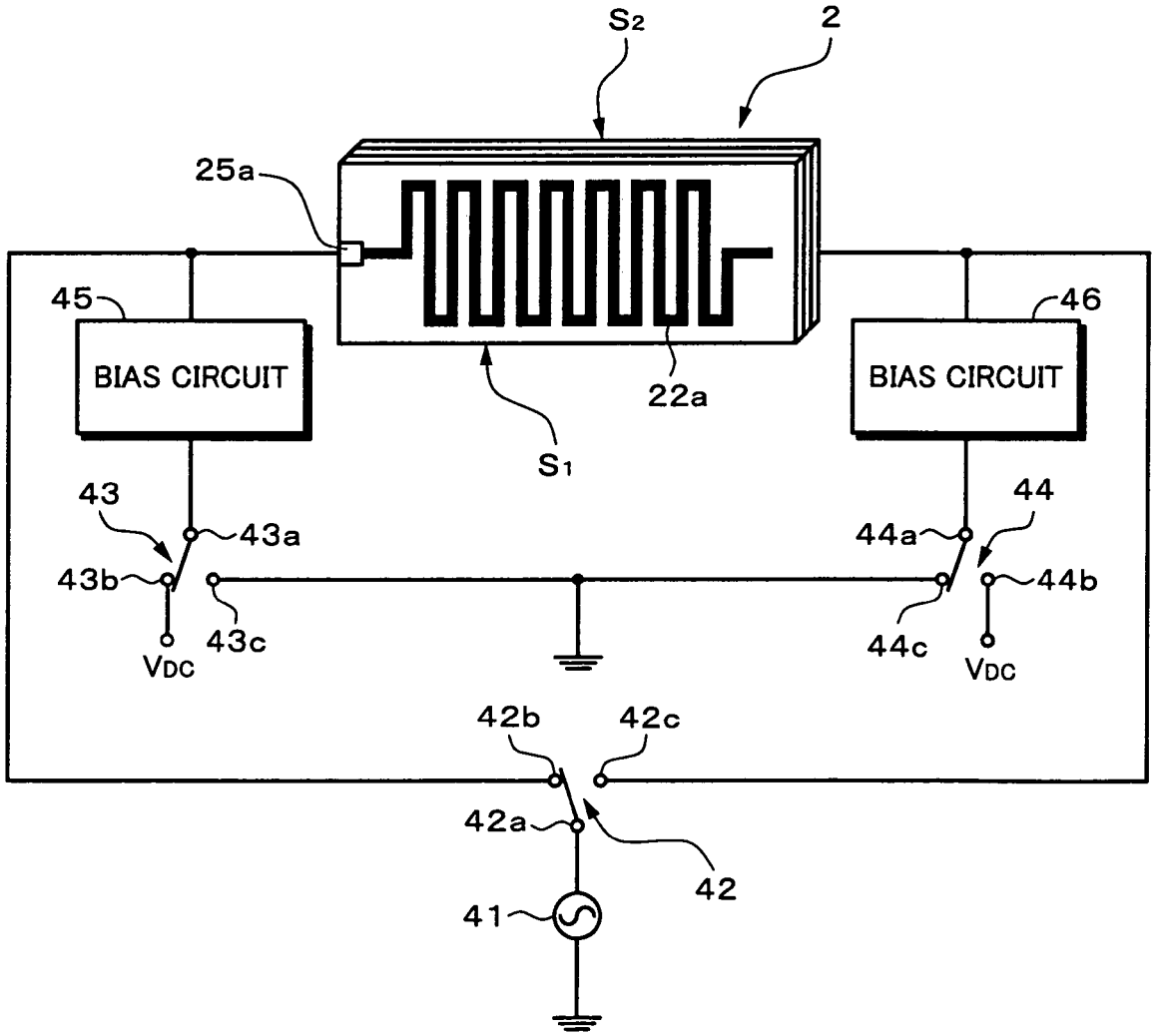
FIG. 6 is a block diagram showing an example of the structure of an antenna apparatus control circuit disposed in the wireless apparatus according to the first embodiment of the present invention.

FIG. 6 is a block diagram showing an example of the structure of an antenna apparatus control circuit that controls the antenna apparatus 2 according to the first embodiment of the present invention. As shown in FIG. 6, the antenna apparatus control circuit mainly has bias circuits 45 and 46 and switches 42, 43, and 44. The switch device 42 is connected to a radio frequency signal circuit block 41.

Disposed on the principal surface $S_1$ of the planer planar antenna substrate 21 is the antenna pattern 22*a*. Disposed on the other principal surface $S_2$ is the antenna pattern 22*b*. The antenna pattern 22*a* disposed on the principal surface $S_1$ is connected to a terminal 43*a* of the switch device 43 through the bias circuit 45. A terminal 43*b* of the switch device 43 is connected to a voltage source (not shown). A terminal 43*c* of the switch device 43 is grounded.

The antenna pattern 22*b* disposed on the principal surface $S_2$ of the antenna apparatus 2 is connected to a terminal 44*a* of the switch device 44 through the bias circuit 46. A terminal 44*b* of the switch device 44 is connected to the voltage source (not shown). A terminal 44*c* of the switch device 44 is grounded.

The antenna pattern 22*a* disposed on the principal surface $S_1$ of the antenna apparatus 2 is connected to a terminal 42*b* of the switch device 42. The antenna pattern 22*b* disposed on the other surface $S_2$ of the antenna apparatus 2 is connected to a terminal 42*c* of the switch device 42. A terminal 42*a* of the switch device 42 is connected to the radio frequency circuit block 41.

For example, a DC voltage $V_{DC}$ is applied between the terminal 43*b* and the terminal 44*c*. The DC voltage $V_{DC}$ is applied between the terminal 44*b* and the terminal 43*c*. Specifically, the DC voltage $V_{DC}$ is applied between the terminal 43*b* and the terminal 44*c* so that the potential of the terminal 43*b* side (the antenna 22*a* side) becomes higher than that of the terminal 44*c* side. The DC voltage $V_{DC}$ is applied between the terminal 44*b* and the terminal 44*c* so that the potential of the terminal 44*b* side (the antenna 22*b* side) becomes higher than that of the terminal 44*c* side.

The bias circuits 45 and 46 stably apply voltages to the antenna apparatus 2. The switch device 42 connects the radio frequency circuit block 41 to one of the antenna patterns 22*a* and 22*b*. The switch devices 43 and 44 select the antenna pattern 22*a* or 22*b* to which the DC voltage $V_{DC}$ is applied so that the potential of the selected antenna pattern becomes higher than that of the non-selected antenna pattern. Specifically, when the terminals 43*a* and 43*b* are connected and the terminals 44*a* and 44*c* are connected, the DC voltage $V_{DC}$ is applied between the antenna patterns 22*a* and 22*b* so that the potential of the antenna pattern 22*a* becomes higher than that of the antenna pattern 22*b*. When the terminals 44*a* and 44*b* are connected and the terminals 43*a* and 43*c* are connected, the DC voltage $V_{DC}$ is applied between the antenna patterns 22*a* and 22*b* so that the potential of the antenna pattern 22*b* becomes higher than that of the antenna pattern 22*a*. The switch devices 43 and 44 are controlled with a control signal supplied from for example the electronic apparatus 11. To miniaturize the entire apparatus including the switch devices 42, 43, and 44, it is preferred that the switch devices 42, 43, and 44 be semiconductor switches (switch ICs (Integrated Circuits)) or RF-MEMSs (Micro Electro Mechanical System) switches.

Figure 7:
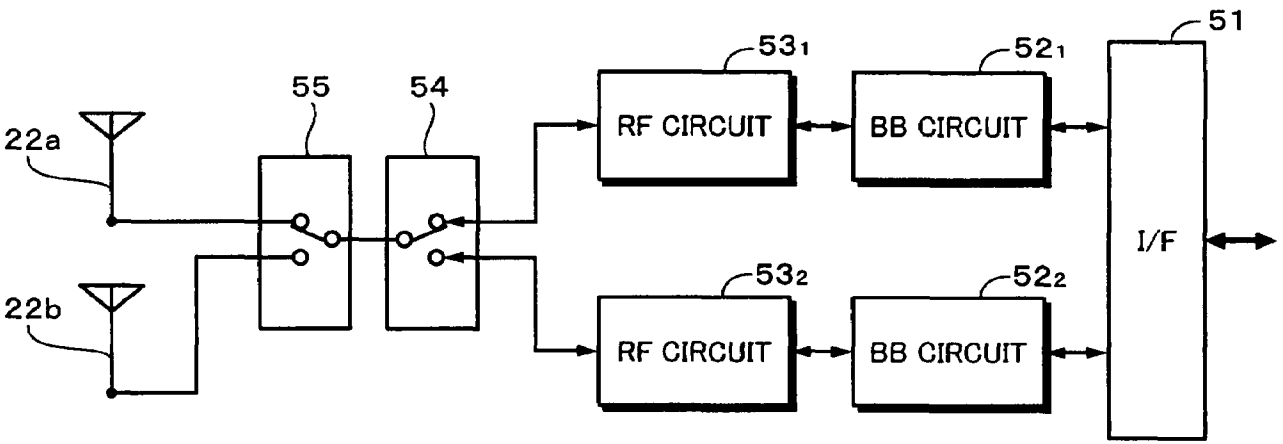
FIG. 7 is a block diagram showing an example of the structure of a signal process circuit disposed in the wireless apparatus according to the first embodiment of the present invention.

FIG. 7 is a block diagram showing an example of the structure of the signal process circuit disposed in the wireless apparatus 1 according to the first embodiment of the present invention. As shown in FIG. 7, the signal process circuit is composed of a host interface (hereinafter referred to as the host I/F) 51, base band circuits (hereinafter referred to as the BB circuits) $\mathbf{52}_1$ and $\mathbf{52}_2$, radio frequency signal process circuits (hereinafter referred to as the RF circuits) $\mathbf{53}_1$ and $\mathbf{53}_2$, a switch device 54, and a switch device 55.

The host I/F 51 allows the wireless apparatus 1 to communicate with the electronic apparatus 11. The BB circuits $\mathbf{52}_1$ and $\mathbf{52}_2$ are control circuits that perform processes such as modulation and demodulation of signals. The RF circuits $\mathbf{53}_1$ and $\mathbf{53}_2$ are circuits that transmit and receive radio frequency signals. The RF circuit $\mathbf{53}_1$ and the BB circuit $\mathbf{52}_1$ are circuits that correspond to the antenna pattern 22*a*. The RF circuit $\mathbf{53}_2$ and the BB circuit $\mathbf{52}_2$ are circuits that correspond to the antenna pattern 22*b*. When the wireless apparatus 1 is an apparatus according to the IEEE 802.11a/b/g standards, the antenna pattern 22*a*, the RF circuit $\mathbf{53}_1$, and the BB circuit $\mathbf{52}_1$ are an antenna and circuits that correspond to 5 GHz bands (IEEE 802.11a), whereas the antenna pattern 22*a*, the RF circuit $\mathbf{53}_2$, and the BB circuit $\mathbf{52}_2$ are an antenna and circuits that correspond to 2.4 GHz bands (IEEE 802.11b/g).

The switch device 54 selects the RF circuit $\mathbf{53}_1$ or $\mathbf{53}_2$ to be connected to the switch device 55. The switch device 55 selects the antenna pattern 22*a* or 22*b* to be connected to the switch device 54.

Next, the operation of the wireless apparatus 1 according to the first embodiment of the present invention will be described.

Figure 8:
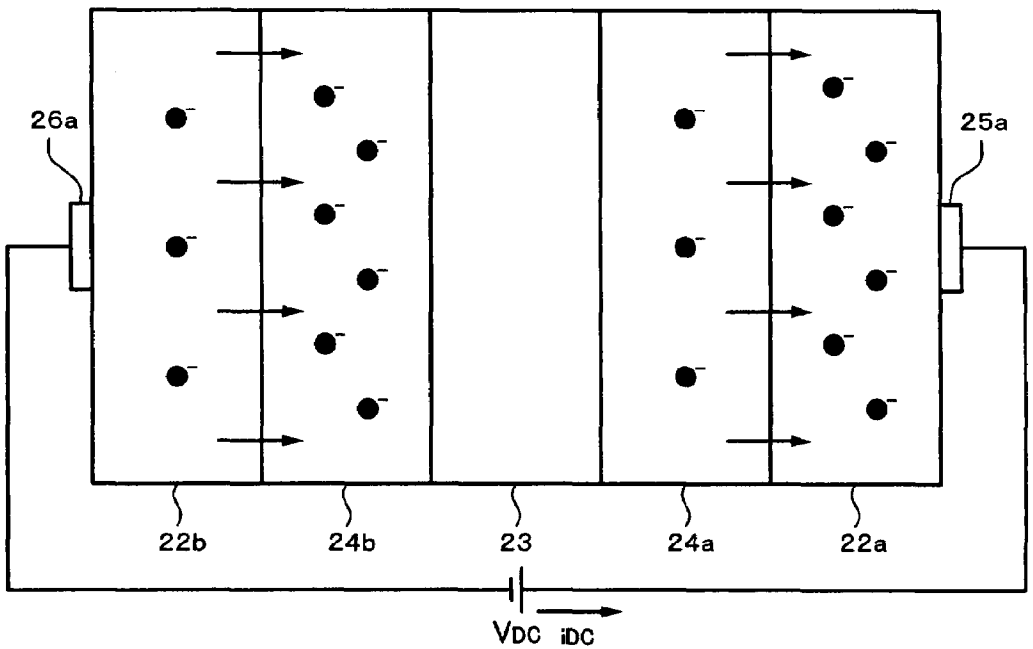
FIG. 8 is a sectional view describing an example of the operation of the wireless apparatus according to the first embodiment of the present invention.

FIG. 8 is a sectional view describing an example of the operation of the wireless apparatus 1 according to the first embodiment. Next, with reference to FIGS. 6 and 8, an example of the operation of the wireless apparatus 1 according to the first embodiment will be described. In this example, it is assumed that ions doped to the antenna patterns 22*a* and 22*b* are anions.

First, the terminals 43*a* and 43*b* of the switch device 43 shown in FIG. 6 are connected. The terminals 44*a* and 44*c* of the switch device 44 are connected. As a result, the DC voltage $V_{DC}$ is applied to the antenna apparatus 2 so that the potential of the antenna pattern 22*a* disposed on the principal surface $S_1$ becomes high and the potential of the antenna pattern 22*b* disposed on the principal surface $S_2$ becomes low. In other words, a DC current $i_{DC}$ flows as shown in FIG. 8.

When the voltage is applied, as shown in FIG. 8, ions of the antenna pattern 22*b* migrate to the solid electrolyte layer 24*b*. In contrast, ions of the solid electrolyte layer 24*a* migrate to the antenna pattern 22*a*. Thus, the antenna pattern 22*b* becomes an insulator, whereas the antenna pattern 22*a* becomes a conductor. In other words, only the antenna pattern 22*a*, which has been doped with ions, functions as an antenna. Thereafter, the terminals 42*a* and 42*b* of the switch device 42 are connected. As a result, a radio frequency signal is supplied form the radio frequency circuit block 41 to the antenna pattern 22*a* disposed on the principal surface $S_1$.

According to the first embodiment of the present invention, the following effects can be obtained.

The antenna apparatus 2 has the separator 23; the antenna substrate 21 composed of the solid electrolyte layers 24*a* and 24*b* disposed on both surfaces of the separator 23; the antenna pattern 22*a* disposed on the solid electrolyte layer 24*a*; and the antenna pattern 22*b* disposed on the solid electrolyte layer 24*b*. When the DC voltage $V_{DC}$ is applied between the antenna patterns 22*a* and 22*b*, ions can be doped to one of the antenna patterns 22*a* and 22*b*, whereas ions can be undoped from the other. In other words, using the potential difference between the antenna patterns 22*a* and 22*b*, one of the antenna patterns 22*a* and 22*b* can become a conductor, whereas the other can become an insulator. Thus, in the antenna apparatus 2, where the two antenna patterns 22*a* and 22*b* are closely disposed, namely, in the antenna apparatus 2, which has the antenna substrate 21, which does not have radio wave shield characteristics and is very thin, the antenna patterns 22*a* and 22*b* disposed on both surfaces of the antenna substrate 21, the antenna patterns 22*a* and 22*b* do not interfere with each other. Thus, deterioration of the characteristic of the antenna apparatus 2 due to interference of the antenna patterns 22*a* and 22*b* can be suppressed. As a result, the areas of the antenna patterns 22*a* and 22*b* can be remarkably decreased. In addition, the degree of freedom of design of the antenna apparatus 2 can be remarkably improved.

In addition, since the antenna patterns 22*a* and 22*b*, which are made of an electroconductive plastic, are disposed on the solid electrolyte layers 24*a* and 24*b* and the antenna patterns 22*a* and 22*b* are actively selected from one to the other with a DC current, unlike the case that the plurality of antenna patterns are made of a metal, even if they are closely disposed, deterioration of the characteristics of the antenna apparatus 2 due to interference of the antenna patterns 22*a* and 22*b* can be suppressed.

In addition, a plurality of antenna patterns 22*a* and 22*b* for different frequency bands corresponding to for example milli-wave bands, IEEE 802.11a/b/g, DTV (Digital Television) tuner, and so forth can be closely disposed without deterioration of the characteristics of the antenna apparatus 2. Thus, the antenna apparatus 2, which can deal with multi-frequency bands and that is small, the wireless apparatus 1 therewith, and the electronic apparatus therewith can be provided.

In addition, various types of antenna patterns such as Zepp, monopole, dipole, and patch antenna patterns can be freely disposed on either or both principal surfaces of the antenna substrate 21. Thus, the degree of freedom of design of the antenna apparatus 2 can be improved.

In addition, unlike antenna patterns made of a hard metal, since the antenna patterns 22*a* and 22*b* are made of a polymer, they have flexibility. Thus, the antenna patterns 22*a* and 22*b* can be disposed in a wearable device. As a result, the degree of flexibility of design of the device can be improved.

In addition, with the switch devices 43 and 44, one of the antenna patterns 22*a* and 22*b* to be functioned can be selected. In addition, a plurality of antenna patterns 22 disposed on the antenna substrate 21 can be freely controlled corresponding to desired frequency characteristics.

Next, a second embodiment of the present invention will be described.

According to the first embodiment, the antenna patterns 22*a* and 22*b* are disposed on the respective principal surfaces of the antenna substrate 21. However, according to the second embodiment, two antenna patterns 22*a* and 22*b* are disposed on one principal surface of an antenna substrate 21. In the second embodiment, similar or corresponding elements to those in the first embodiment are denoted by similar or corresponding reference numerals and their description will be omitted.

Figure 9:
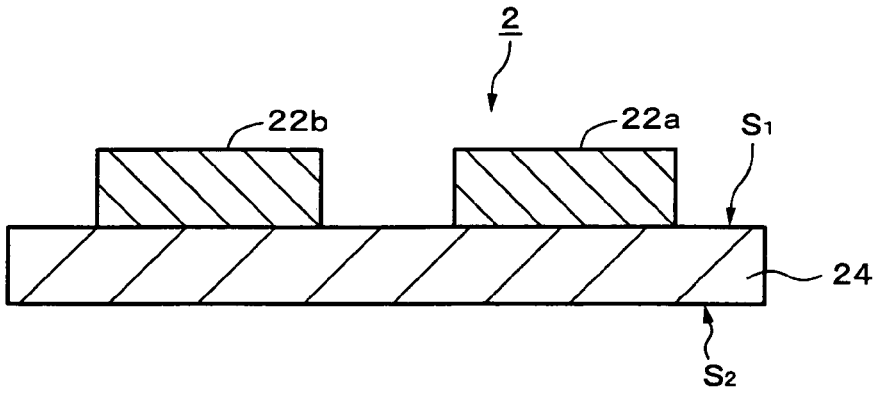
FIG. 9 is a sectional view showing an example of the structure of an antenna apparatus according to a second embodiment of the present invention.

FIG. 9 is a sectional view showing an example of the structure of an antenna apparatus according to the second embodiment of the present invention. As shown in FIG. 9, the antenna apparatus 2 has a solid electrolyte layer 24 and antenna patterns 22*a* and 22*b* disposed on one principal surface $S_1$ of the solid electrolyte layer 24.

Figure 10:
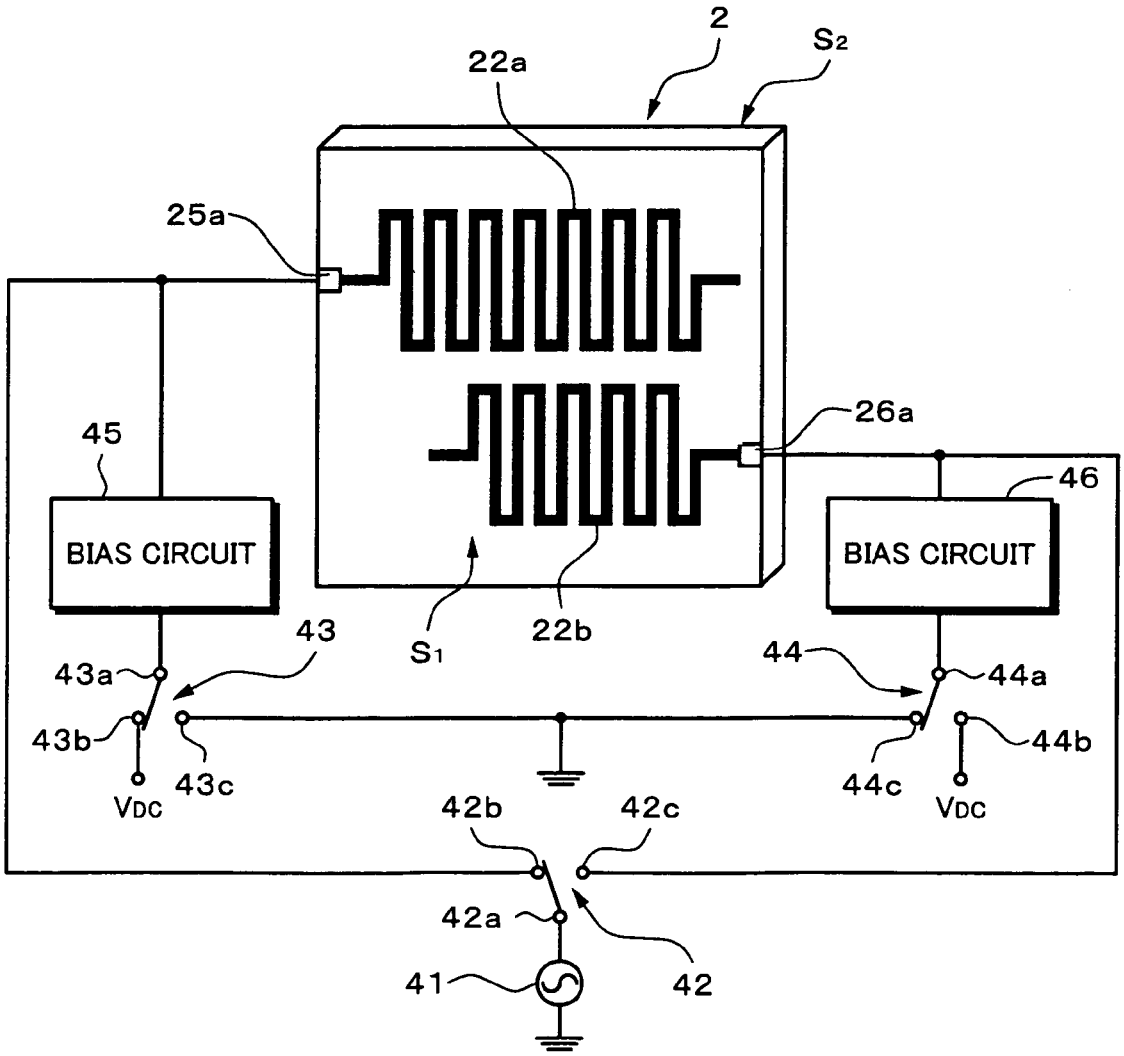
FIG. 10 is a block diagram showing an example of the structure of an antenna apparatus control circuit disposed in a wireless apparatus according to the second embodiment of the present invention.

FIG. 10 is a block diagram showing an example of the structure of an antenna apparatus control circuit that controls the antenna apparatus 2 according to the second embodiment of the present invention. The antenna pattern 22*a* disposed on the principal surface $S_1$ is connected to a terminal 43*a* of a switch device 43 through a bias circuit 45 and connected to a terminal 42*b* of a switch device 42. The antenna pattern 22*b* disposed on the principal surface $S_1$ is connected to a terminal 44*a* of a switch device 44 through a bias circuit 46 and connected to a terminal 42*c* of the switch device 42.

Next, the operation of a wireless apparatus 1 according to the second embodiment of the present invention will be described.

Figure 11:
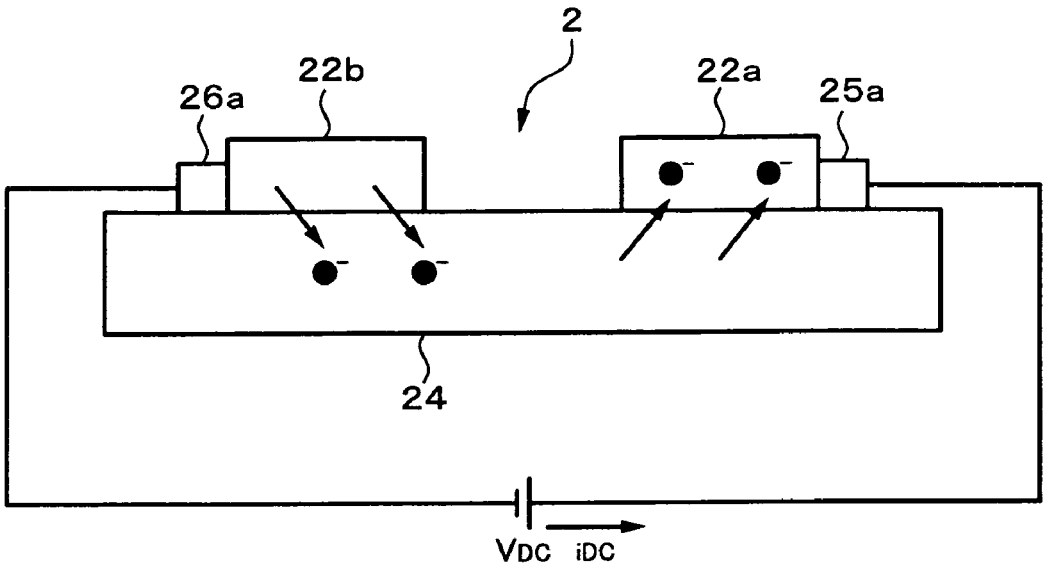
FIG. 11 is a sectional view describing an example of the operation of the wireless apparatus according to the second embodiment of the present invention.

FIG. 11 is a sectional view describing an example of the operation of the wireless apparatus 1 according to the second embodiment of the present invention. Next, with reference to FIG. 10 and FIG. 11, an example of the operation of the wireless apparatus 1 according to the second embodiment will be described.

The terminals 43*a* and 43*b* of the switch device 43 shown in FIG. 10 are connected. The terminals 44*a* and 44*c* of the switch device 44 are connected. A DC voltage VDC is applied to the antenna apparatus 2 so that the potential of the antenna pattern 22*a* becomes high and the potential of the antenna pattern 22*b* becomes low. In other words, a DC current $i_{DC}$ flows as shown in FIG. 11.

When the voltage is applied, as shown in FIG. 11, ions of the antenna pattern 22*b* migrate to the solid electrolyte layer 24. Ions of the solid electrolyte layer 24 migrate to the antenna pattern 22*a*. Thus, the antenna pattern 22*b* becomes an insulator, whereas the antenna pattern 22*a* becomes a conductor. In other words, only the antenna pattern 22*a*, which has been doped with ions, functions as an antenna. Thereafter, the terminals 42*a* and 42*b* of the switch device 42 are connected. Thus, a radio frequency signal is supplied from the radio frequency circuit block 41 to the antenna pattern 22*a*. Since the rest of the operation of the wireless apparatus 1 of the second embodiment is the same as that of the first embodiment, the description will be omitted.

According to the second embodiment of the present invention, the same effects as the first embodiment can be obtained.

Next, a third embodiment of the present invention will be described.

In the second embodiment, the antenna substrate 21 is composed of only the solid electrolyte layer 24. According to the third embodiment, an antenna substrate 21 is composed of a solid electrolyte layer 24 and a base plate disposed on one principal surface of the solid electrolyte 21. In the third embodiment, similar or corresponding elements to those in the first embodiment are denoted by similar or corresponding reference numerals and their description will be omitted.

Figure 12:
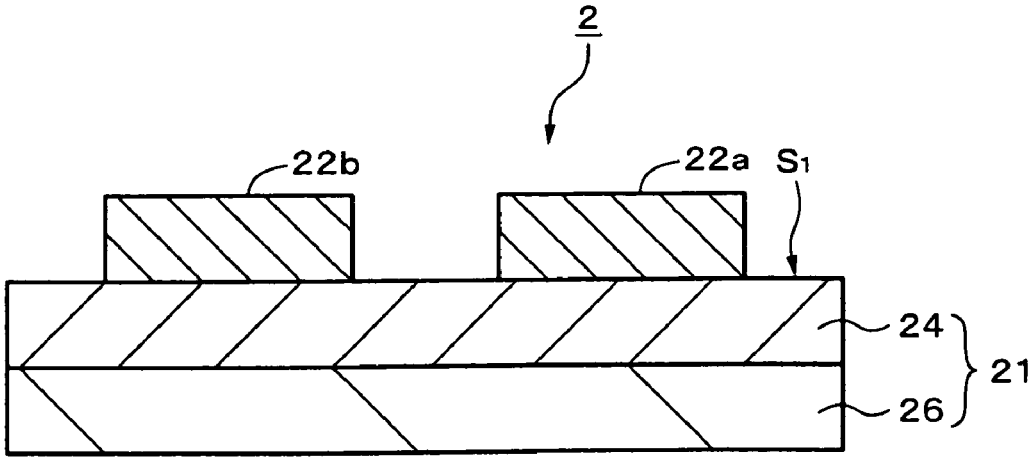
FIG. 12 is a sectional view showing an example of the structure of a wireless apparatus according to a third embodiment of the present invention.
Figure 13:
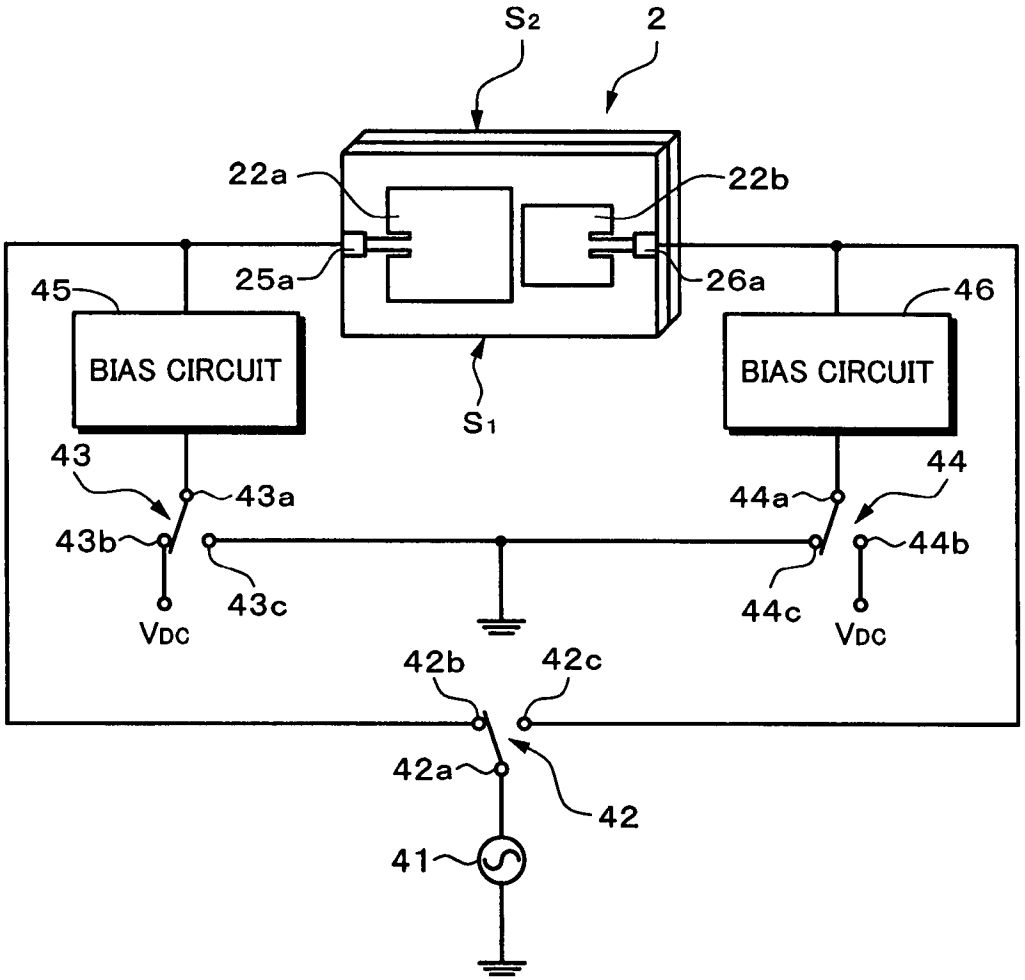
FIG. 13 is a block diagram showing an example of the structure of an antenna apparatus control circuit disposed in the wireless apparatus according to the third embodiment of the present invention.

FIG. 12 shows an example of the structure of an antenna apparatus 2 according to the third embodiment of the present invention. FIG. 13 is a block diagram showing an example of the structure of an antenna apparatus control circuit that controls the antenna apparatus 2 according to the third embodiment of the present invention. As shown in FIG. 12, the antenna apparatus 2 according to the third embodiment is mainly composed of a solid electrolyte layer 24; antenna patterns 22*a* and 22*b* disposed on one principal surface $S_1$ of the solid electrolyte layer 24; and a base plate 26 disposed on the other principal surface of the solid electrolyte layer 24. The antenna patterns 22*a* and 22*b* are for example linear patterns or planar patterns. The linear patterns are for example monopole type. The planar patterns are for example microstrip type antennas or PIFAs (Planer Inverted F Antennas). As shown in FIG. 13, the structure of the antenna apparatus control circuit is the same as that of the second embodiment. Since the rest of the structure of the antenna apparatus 2 of the third embodiment is the same as that of the second embodiment, the description thereof will be omitted.

According to the third embodiment of the present invention, the same effects as the first embodiment can be obtained.

Next, a fourth embodiment of the present invention will be described. In the first, second, and third embodiments, examples of which the two antenna patterns 22*a* and 22*b* are disposed on the antenna substrate 21 were described. In the fourth embodiment, however, an example of which a plurality of (three or more) antenna patterns are disposed on an antenna substrate 21 will be described. In the following description, it is assumed that two antenna patterns are disposed on each of principal surfaces $S_1$ and $S_2$ of the antenna substrate 21. In the fourth embodiment, similar or corresponding elements to those in the first embodiment are denoted by similar or corresponding reference numerals and their description will be omitted.

Figure 14:
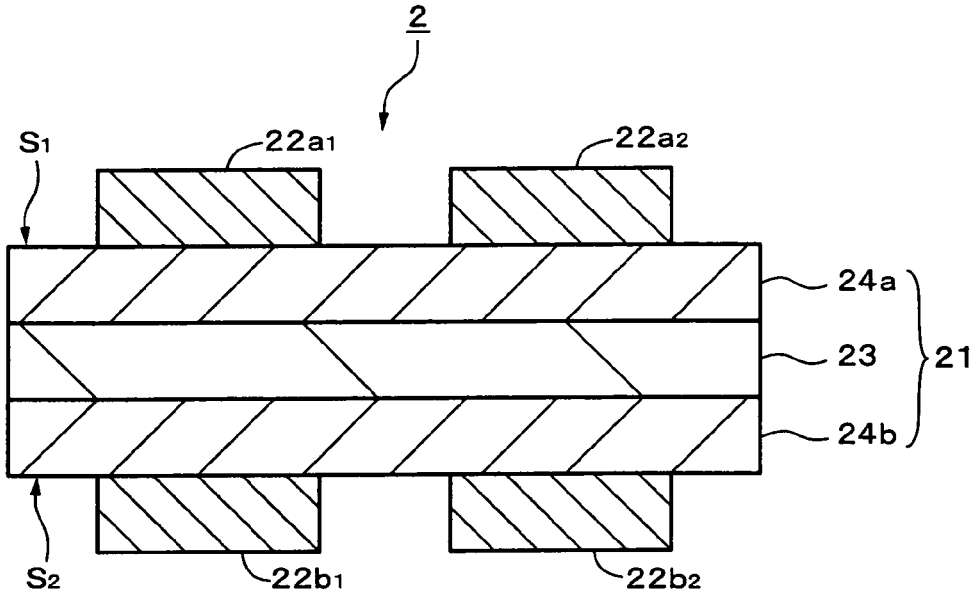
FIG. 14 is a sectional view showing an example of the structure of an antenna apparatus according to a fourth embodiment of the present invention.

FIG. 14 shows an example of the structure of an antenna apparatus 2 according to the fourth embodiment of the present invention. Antenna patterns $\mathbf{22}a_1$ and $\mathbf{22}a_2$ are disposed on one principal surface $S_1$ of an antenna substrate 21. Antenna patterns $\mathbf{22}b_1$ and $\mathbf{22}b_2$ are disposed on another principal surface $S_2$ of the antenna substrate 21.

Figure 15:
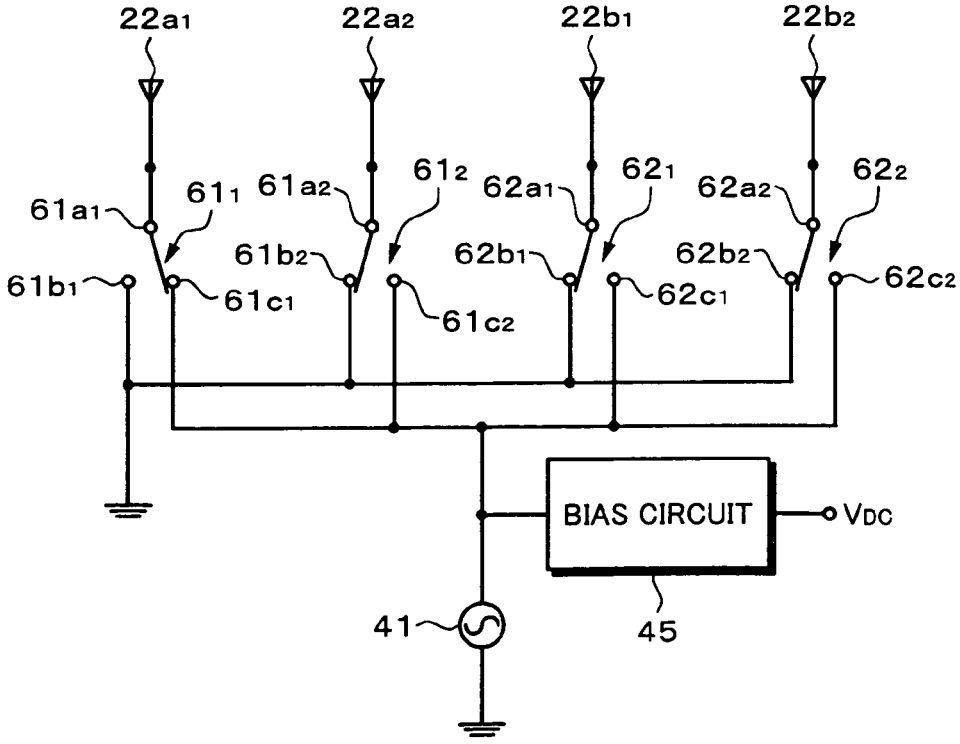
FIG. 15 is a block diagram showing an example of the structure of an antenna apparatus control circuit disposed in a wireless apparatus according to the fourth embodiment of the present invention.

FIG. 15 is a block diagram showing an example of the structure of an antenna apparatus control circuit that controls the antenna apparatus 1 according to the fourth embodiment of the present invention. In FIG. 15, for convenience, the antenna substrate 21 is omitted.

The antenna patterns $\mathbf{22}a_1$ and $\mathbf{22}a_2$ are disposed on the principal surface $S_1$ of the antenna substrate 21. The antenna patterns $\mathbf{22}b_1$ and $\mathbf{22}b_2$ are disposed on the principal surface $S_2$ of the antenna substrate 21. The antenna patterns $\mathbf{22}a_1$ and $\mathbf{22}a_2$ disposed on the principal surface $S_1$ are connected to terminals $\mathbf{61}a_1$ and $\mathbf{61}a_2$, respectively. Terminals $\mathbf{61}b_1$ and $\mathbf{61}b_2$ are grounded. Terminals $\mathbf{61}c_1$ and $\mathbf{61}c_2$ are connected to a radio frequency circuit block 41.

The antenna patterns $\mathbf{22}b_1$ and $\mathbf{22}b_2$ disposed on the principal surface $S_2$ are connected to terminals $\mathbf{62}a_1$ and $\mathbf{62}a_2$, respectively. Terminals $\mathbf{62}b_1$ and $\mathbf{62}b_2$ are grounded. Terminals $\mathbf{62}c_1$ and $\mathbf{62}c_2$ are connected to the radio frequency circuit block 41. The terminals $\mathbf{61}c_1$, $\mathbf{61}c_2$, $\mathbf{62}c_1$, and $\mathbf{62}c_2$ are connected to a voltage source (not shown) through a bias circuit 45.

Figure 16:
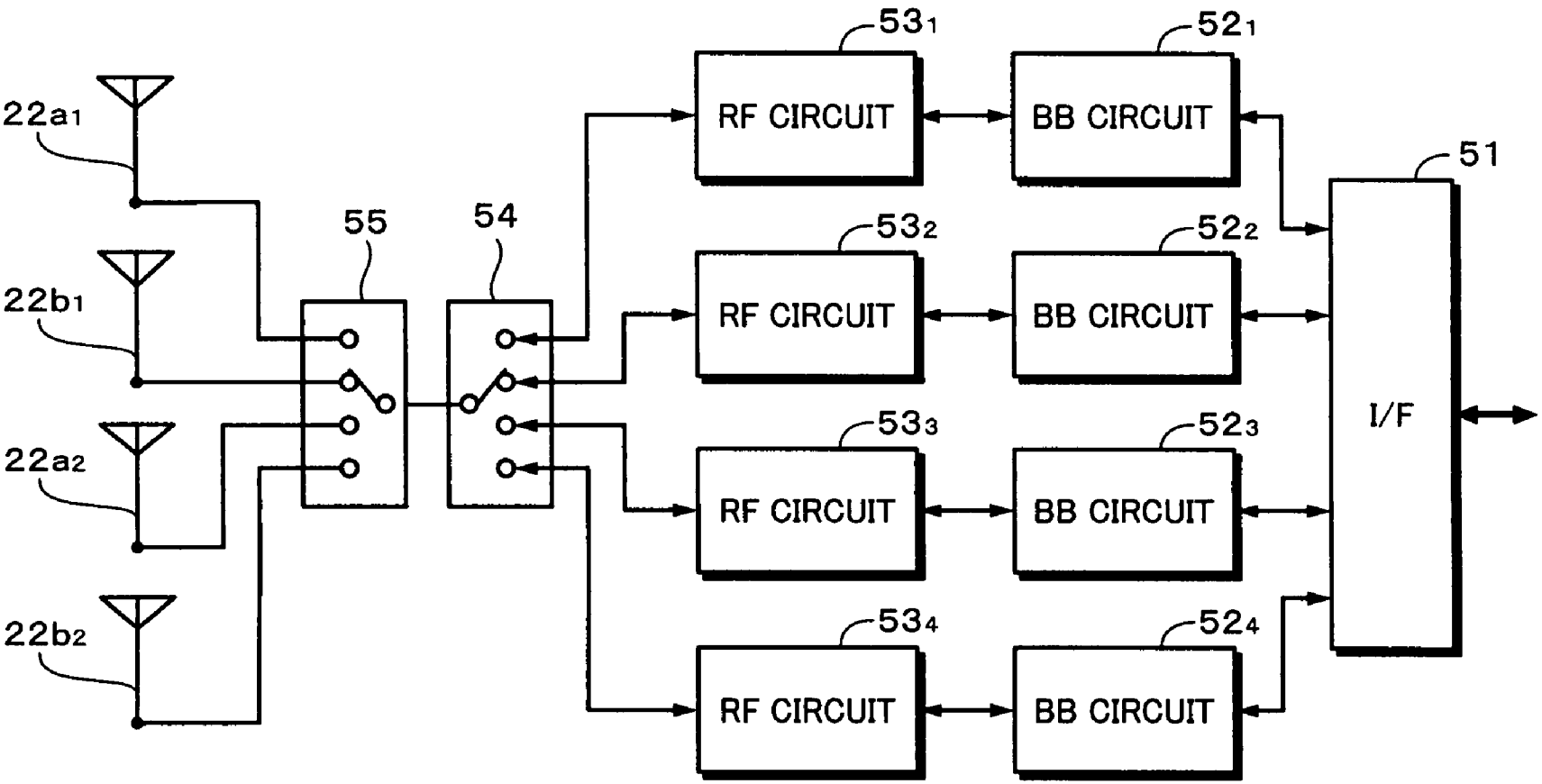
FIG. 16 is a block diagram showing an example of the structure of a signal process circuit disposed in the wireless apparatus according to the fourth embodiment of the present invention.
Figure 17A:
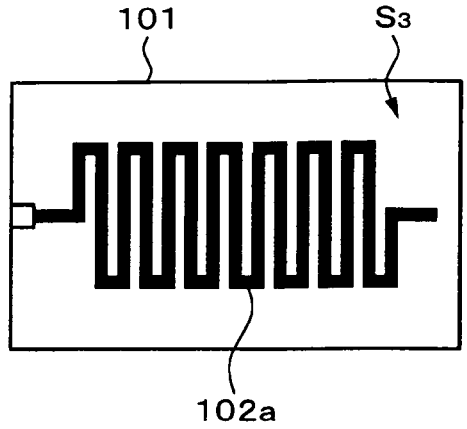
FIG. 17 is a schematic diagram showing a conventional antenna apparatus.
Figure 17B:
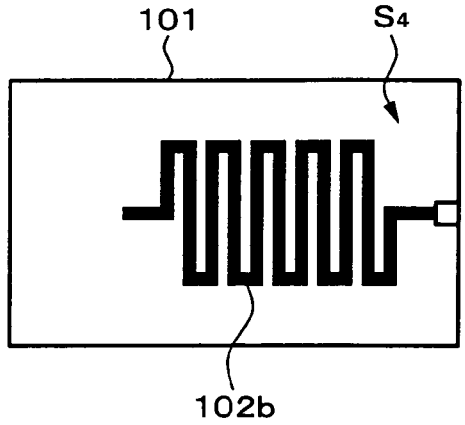
Figure 18:
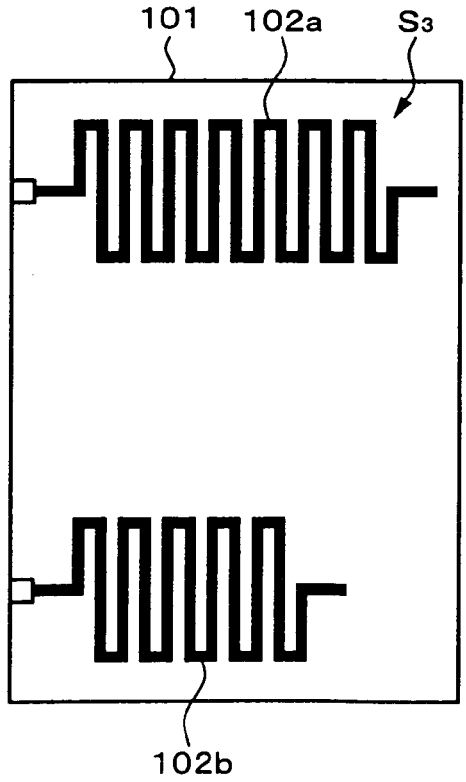
FIG. 18 is a schematic diagram showing a conventional antenna apparatus.

FIG. 16 shows an example of the structure of a signal process circuit disposed in the wireless apparatus 1 according to the fourth embodiment of the present invention. A switch device 55 selects one of the antenna patterns $\mathbf{22}a_1$, $\mathbf{22}a_2$, $\mathbf{22}b_1$, and $\mathbf{22}b_2$ to be connected to a switch device 54. The switch device 54 selects one of RF circuits $\mathbf{53}_1$, $\mathbf{53}_2$, $\mathbf{53}_3$, and $\mathbf{53}_4$ to be connected to the switch device 55.

The RF circuits $\mathbf{53}_1$, $\mathbf{53}_2$, $\mathbf{53}_3$, and $\mathbf{53}_4$ are circuits that transmit and receive a radio frequency signal. BB circuits $\mathbf{52}_1$, $\mathbf{52}_2$, $\mathbf{52}_3$, and $\mathbf{52}_4$ are control circuits that perform processes such as modulation and demodulation of a signal. The RF circuit $\mathbf{53}_1$ and the BB circuit $\mathbf{52}_1$ are circuits corresponding to the antenna $\mathbf{22}a_1$. The RF circuit $\mathbf{53}_2$ and the BB circuit $\mathbf{52}_2$ are circuits corresponding to the antenna $22b_1$. The RF circuit $53_3$ and the BB circuit $52_3$ are circuits corresponding to the antenna $22a_2$. The RF circuit $53_4$ and the BB circuit $52_4$ are circuits corresponding to the antenna $22b_2$. The antenna pattern $22a_1$, the RF circuit $53_1$, and the BB circuit $52_1$ are an antenna and circuits corresponding to for example 5 GHz bands (IEEE 802.11a). The antenna pattern $22b_1$, the RF circuit $53_2$, and the BB circuit $52_2$ are an antenna and circuits corresponding to for example 2.4 GHz bands (IEEE 802.11b/g). The antenna pattern $22a_2$, the RF circuit $53_3$, and the BB circuit $52_3$ are an antenna and circuits corresponding to for example UHF bands (DTV). The antenna pattern $22b_2$, the RF circuit $53_4$, and the BB circuit $52_4$ are an antenna and circuits corresponding to for example MMW (Millimeter wave) bands.

Next, the operation of the wireless apparatus 1 according to the fourth embodiment of the present invention will be described. In this operation, it is assumed that only the antenna pattern $22a_1$ of the antenna patterns $22a_1$, $22a_2$, $22b_1$, and $22b_2$ is functioned as an antenna.

First, the terminals $61a_1$ and $61c_1$ of the switch device $61_1$ are connected. The terminals $61a_2$ and $61b_2$ of the switch device $61_2$ are connected. The terminals $62a_1$ and $62b_1$ of the switch device $62_1$ are connected. The terminals $62a_2$ and $62b_2$ of the switch device $62_2$ are connected. Thus, a DC voltage $V_{DC}$ is applied between the terminal $61c_1$ and the terminals $61b_2$, $62b_1$ and $62b_2$ so that the potential of the antenna pattern $22a_1$ becomes high and the potentials of the antenna patterns $22a_2$, $22b_1$, and $22b_2$ become low.

When the voltage is applied, ions of the antenna pattern $22a_2$, $22b_1$, and $22b_2$ migrate to the solid electrolyte layers 24*a* and 24*b*. Ions of the solid electrolyte layer 24*a* migrate to the antenna pattern $22a_1$. Thus, the antenna patterns $22a_2$, $22b_1$, and $22b_2$ become insulators, whereas the antenna pattern $22a_1$ becomes a conductor. In other words, only the antenna pattern $22a_1$, which has been doped with ions, functions as an antenna. A radio frequency wave is supplied from the radio frequency circuit block 41 to the antenna pattern $22a_1$, which becomes a conductor. Since the rest of the operation of the antenna apparatus 2 of the fourth embodiment is the same as that of the first embodiment, the description thereof will be omitted.

According to the fourth embodiment, the same effects as the first embodiment can be obtained.

Although the first, second, third, and fourth embodiments of the present invention were specifically described, it should be appreciated that the present invention is not limited to the first, second, third, and fourth embodiments. Instead, various modifications based on the technical idea of the present invention can be made.

For example, according to the first, second, third, and fourth embodiments, values and structures described therein are only examples. If necessary, different values and structures may be used.

According to the first, second, third, and fourth embodiments, the solid electrolyte has for example a planar shape. Instead, the solid electrolyte may have for example a spherical shape or a polyhedral shape such as an ellipsoid shape, a cubic shape, or a cuboid shape.

According to the first, second, third, and fourth embodiments, only one of a plurality of antenna patterns is doped with ions to function it as an antenna. Instead, at least two of a plurality of antenna patterns may be doped with ions to function them as antennas. In this case, a plurality of antenna patterns need to be paired and spaced so that they do not interfere with each other.

In the first, second, third, and fourth embodiments, the present invention is applied to the wireless apparatus 1, which can be attached to and detached from the electronic apparatus 11 such as a personal computer. Of course, the present invention can be applied to an electronic apparatus that has a wireless communication function as a built-in function. For example, the present invention can be applied to a portable information device that has a wireless function. In this case, since the antenna apparatus 2 can be disposed at any position, the electronic apparatus such as a portable information device can be more miniaturized.

In addition, the antenna apparatus 2 according to the first, second, third, and fourth embodiments may be adhered on the front surface of the electronic apparatus such as a portable information terminal. In this case, the space for the antenna apparatus 2 can be omitted. Thus, the electronic apparatus such as a portable information terminal can be more miniaturized.

According to the first, second, third, and fourth embodiments, the present invention is applied to the wireless apparatus 1. Instead, the present invention may be applied to a wearable device.

According to the first, second, third, and fourth embodiments, a protective layer that covers the antenna pattern 22 of the antenna apparatus 2 may be additionally disposed. The material of the protective layer needs to be a material that does not deteriorate the characteristics of radio waves of the antenna pattern 22. With this structure, the durability of the antenna apparatus 2 can be improved.

According to the first, second, third, and fourth embodiments, a plurality of antenna patterns corresponding to different frequency bands are closely disposed. Instead, a plurality of antenna patterns corresponding to the same frequency band, but different center frequencies may be closely disposed to widen the frequencies with which the antenna apparatus 2 can deal.

| DESCRIPTION OF REFERENCE NUMERALS | |
|---|---|
| 1 | WIRELESS APPARATUS |
| 2, 101 | ANTENNA APPARATUS |
| 3 | WIRELESS APPARATUS MAIN BODY |
| 11 | ELECTRONIC APPARATUS |
| 12 | SLOT |
| 21 | ANTENNA SUBSTRATE |
| 22, 102 | ANTENNA PATTERN |
| 23 | SEPARATOR |
| 24 | SOLID ELECTROLYTE LAYER |
| 25, 26 | ELECTRODE |
| 31 | MAIN BODY SUBSTRATE |
| 32 | CONNECTION TERMINAL |
| 33 | CIRCUIT PORTION |
| 41 | RADIO FREQUENCY CIRCUIT |
| 42, 43, 44 | SWITCH DEVICE |
| 54, 55 | SWITCH DEVICE |
| 61, 62 | SWITCH DEVICE |
| 45, 46 | BIAS CIRCUIT |
| 51 | HOST INTERFACE |
| 52 | BASE BAND CIRCUIT |
| 53 | RADIO FREQUENCY CIRCUIT |

The invention claimed is:

1. An antenna apparatus, comprising:

a substrate; and a plurality of antenna patterns disposed on the substrate, wherein the antenna patterns being made of an electroconductive plastic, the electroconductive plastic (i) transforming to an electroconductive resin when doped with ions and (ii) transforming to an insulative resin when dedoped, and wherein the substrate is made of a solid electrolyte including ions used to dope the electroconductive plastic.

2. The antenna apparatus as set forth in claim 1, wherein the substrate includes an insulative separator, wherein solid electrolyte layers made of the solid electrolyte are disposed on both surfaces of the separator.

3. The antenna apparatus as set forth in claim 1, wherein the plurality of antenna patterns correspond to different frequency bands.

4. The antenna apparatus as set forth in claim 1, wherein the plurality of antenna patterns are linear patterns.

5. The antenna apparatus as set forth in claim 1, wherein the substrate is a planar substrate.

6. The antenna apparatus as set forth in claim 5, wherein the plurality of antenna patterns are disposed on both principal surfaces of the substrate.

7. The antenna apparatus as set forth in claim 5, wherein the plurality of antenna patterns are disposed on one principal surface of the substrate.

8. The antenna apparatus as set forth in claim 7, further comprising:

a base plate made of a metal and disposed on the other principal surface of the substrate.

9. The antenna apparatus as set forth in claim 8, wherein the plurality of antenna patterns are planner patterns.

10. A wireless apparatus that is connected to a device and that allows it to additionally have a wireless function, the wireless apparatus comprising:

a substrate;

a plurality of antenna patterns disposed on the substrate; and switches configured to select the plurality of antenna patterns so that one of the plurality of antenna patterns has one potential and the other of the plurality of antenna patterns has another potential when a DC voltage is applied between the plurality of antenna patterns;

wherein the antenna patterns are made of an electroconductive plastic, the electroconductive plastic (i) transforming to an electroconductive resin when doped with ions and (ii) transforming to an insulative resin when dedoped, and wherein the substrate is made of a solid electrolyte including ions used to dope the electroconductive plastic.

11. The wireless apparatus as set forth in claim 10, wherein the substrate includes an insulative separator, and wherein solid electrolyte layers made of the solid electrolyte are disposed on both surfaces of the separator.

12. The wireless apparatus as set forth in claim 10, wherein the plurality of antenna patterns correspond to different frequency bands.

13. The wireless apparatus as set forth in claim 10, wherein the plurality of antenna patterns are linear patterns.

14. The wireless apparatus as set forth in claim 10, wherein the substrate is a planar substrate.

15. The wireless apparatus as set forth in claim 14, wherein the plurality of antenna patterns are disposed on both principal surfaces of the substrate.

16. The wireless apparatus as set forth in claim 14, wherein the plurality of antenna patterns are disposed on one principal surface of the substrate.

17. The wireless apparatus as set forth in claim 16, further comprising:

a base plate made of a metal and disposed on the other principal surface of the substrate.

18. The wireless apparatus as set forth in claim 17, wherein the plurality of antenna patterns are planner patterns.

19. An electronic apparatus having a wireless communication function that transmits and receives information, the electronic apparatus comprising:

a substrate;

a plurality of antenna patterns disposed on the substrate;

a voltage source that applies a DC voltage between the plurality of antenna patterns; and switches configured to select the plurality of antenna patterns so that one of the plurality of antenna patterns has one potential and the other of the plurality of antenna patterns has another potential when the DC voltage is applied between the plurality of antenna patterns, wherein the antenna patterns are made of an electroconductive plastic, the electroconductive plastic (i) transforming to an electroconductive resin when doped with ions and (ii) transforming to an insulative resin when dedoped, and wherein the substrate is made of a solid electrolyte including ions used to dope the electroconductive plastic.

20. The electronic apparatus as set forth in claim 19, wherein the substrate includes an insulative separator, wherein solid electrolyte layers made of the solid electrolyte are disposed on both surfaces of the separator.

21. The electronic apparatus as set forth in claim 19, wherein the plurality of antenna patterns correspond to different frequency bands.

22. The electronic apparatus as set forth in claim 19, wherein the plurality of antenna patterns are linear patterns.

23. The electronic apparatus as set forth in claim 19, wherein the substrate is a planar substrate.

24. The electronic apparatus as set forth in claim 23, wherein the plurality of antenna patterns are disposed on both principal surfaces of the substrate.

25. The electronic apparatus as set forth in claim 23, wherein the plurality of antenna patterns are disposed on one principal surface of the substrate.

26. The electronic apparatus as set forth in claim 25, further comprising:

a base plate made of a metal and disposed on the other principal surface of the substrate.

27. The electronic apparatus as set forth in claim 26, wherein the plurality of antenna patterns are planner patterns.

* * * * *